United States Patent [19]

Schweiger et al.

[11] Patent Number: 4,822,618

[45] Date of Patent: Apr. 18, 1989

[54] CAPSULES

[75] Inventors: Bernard Schweiger, Fegersheim; Alfred Wagner, Gerstheim, both of France

[73] Assignee: Lilly Industries Limited, Basingstoke, England

[21] Appl. No.: 49,640

[22] Filed: May 13, 1987

[30] Foreign Application Priority Data

May 15, 1986 [GB] United Kingdom ..... 8611905

[51] Int. Cl.[4] ..... A61J 1/04

[52] U.S. Cl. ..... 424/453; 424/454

[58] Field of Search ..... 428/35, 320.2, 321.1, 428/321.5; 53/900, 471; 424/453, 454

[56] References Cited

U.S. PATENT DOCUMENTS

| | | | |
|---|---|---|---|
| 3,664,495 | 5/1972 | Graham et al. | 206/63.2 R |
| 3,775,015 | 11/1973 | Tsunoda et al. | 53/471 |
| 4,196,564 | 4/1980 | Bodenmann et al. | 53/900 |
| 4,250,997 | 2/1981 | Bodenmann et al. | 206/528 |
| 4,403,461 | 9/1983 | Goutard et al. | 53/900 |
| 4,478,658 | 10/1984 | Wittwer | 53/900 |
| 4,667,498 | 5/1987 | Sauter | 72/108 |
| 4,677,812 | 7/1987 | Tayebi | 53/900 |

FOREIGN PATENT DOCUMENTS

| | | | |
|---|---|---|---|
| 110500 | 6/1984 | European Pat. Off. | 3/7 |
| 143524 | 6/1985 | European Pat. Off. | 3/7 |
| 1108629 | 4/1968 | United Kingdom | 1/4 |
| 1177587 | 1/1970 | United Kingdom | 3/7 |

*Primary Examiner*—Nancy A. B. Swisher

*Attorney, Agent, or Firm*—Douglas J. Taylor; Leroy Whitaker

[57] ABSTRACT

A gelatin capsule cap has an annular groove in the region of its open end to reduce ovality.

20 Claims, 1 Drawing Sheet

CAPSULES

Figure 1:
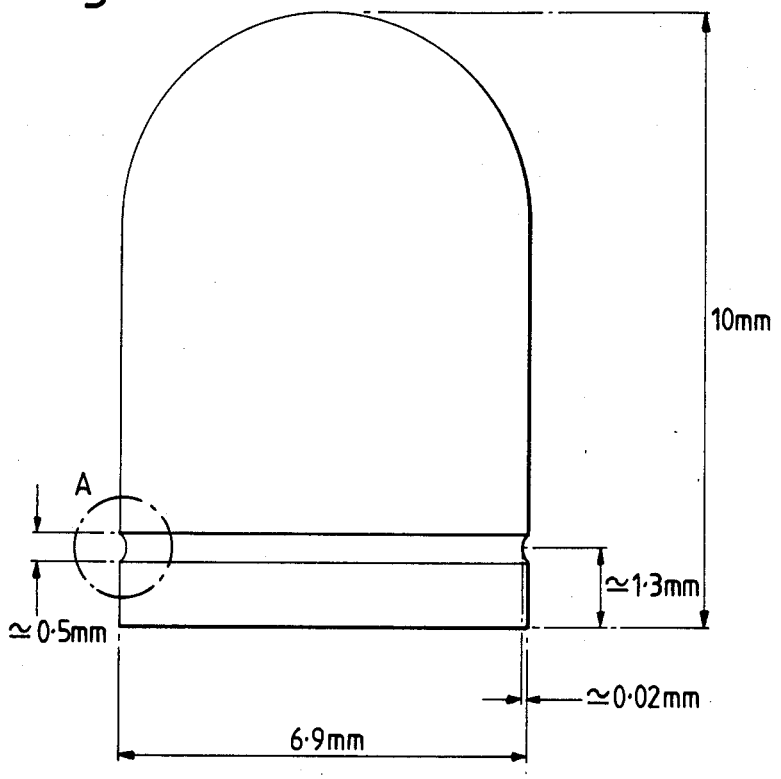

This invention relates to capsules of the sort comprising a generally cylindrical body portion and a cap portion adapted to fit telescopically onto the body portion, and in particular to hard gelatin capsules of the sort commonly employed to contain pharmaceutical preparations.

Hard gelatin capsules are made in two parts by dipping steel pins into a molten gelatin solution, allowing the gelatin to set and dry, and stripping the shells so formed off the pins.

It is generally known that the gelatin film, as it dries, also undergoes shrinkage. Control of humidity during and after the drying process is critical to the dimensional stability of the formed capsules. The shrinkage depends on a number of factors such as the amount of water to be eliminated, the type of gelatin used, the drying regime and the number and type of additives such as dyes or surfactants. The capsules undergo a further loss of up to 3% moisture after being stripped from the pins on which they are formed.

The effect of variations in the drying conditions and gelatin composition lead to variations in the diameters of the formed and dried shells. In addition, the effect of gelatin flow in the dip pan on the film formation, together with the conicity of the pin and the presence of profiles which may be present, such as those provided to allow locking of the capsule halves on assembly, combine with the drying system to cause the cross-section of the dried capsule to depart from circularity, thus producing an oval mouth.

One effect of this ovality is to produce difficulties in assembling the two halves of the capsule. Instead of telescopically engaging each other, the two halves may come into abutment, with possible splitting of one or both halves of the capsule with immediate or subsequent loss of the capsule contents.

Attempts have been made to overcome the problems of ovality, for example by modifying the design. However, until now it has not proved possible to find a satisfactory solution to the problem, and measurements carried out on size 1 capsule caps of nominal diameter 6.9 mm have shown that the ovality, as determined by measuring the difference between the largest and the smallest diameters, is as high as 0.3 mm, whatever the manufacturing source of the capsule is.

The present invention provides a solution of the ovality problem, without requiring a modification of the capsule forming and drying conditions.

This invention provides a capsule shell having an annular groove in the region of the open end. The groove is preferably in the capsule cap.

By "in the region of the open end" is meant spaced at a short distance from the open end, i.e. no more than 2 mm and preferably between about 0.5 mm and about 1.5 mm from the cut edge, depending on the capsule size.

The presence of the annular groove allows the capsule film to be dried under the usual conditions with a greatly reduced tendency to become oval. In a size 1 capsule, for example, the groove may preferably be positioned at a distance of from about 0.5 mm to about 1.6 mm from the open end of the shell. The groove is preferably continuous. However, it is possible to achieve the advantages of the decreased ovality using a segmented groove having, for example, from about 2 to about 12 segments. The segments should preferably encircle at least about 90% of the circumference of the shell. Typically, the width of the groove is from about 0.3 mm to about 1.5 mm, with a depth of from about 0.01 mm to about 0.05 mm.

The dimensions, cross-sectional profile and position of the groove are not critical. The preferred dimensions will depend on the size of the capsule. Thus for the common capsule sizes the parameters may typically be selected from those shown in the following table.

| Capsule Size | Groove Depth (mm) | Distance from Cut Edge (mm)* | Groove Width (mm) |
|---|---|---|---|
| 00 | 0.025–0.035 | 1–1.6 | 0.51–0.55 |
| 0 | 0.025–0.035 | 1–1.6 | 0.51–0.55 |
| 1 | 0.020–0.030 | 1–1.6 | 0.46–0.50 |
| 2 | 0.015–0.025 | 0.8–1.4 | 0.37–0.41 |
| 3 | 0.010–0.020 | 0.7–1.3 | 0.32–0.36 |
| 4 | 0.010–0.020 | 0.7–1.3 | 0.32–0.36 |

*Measured to the centre of the groove.

The cross-section of the groove may have a profile which is curved or angular, and may range in shape, for example, from a single to a multiple radius design, or from a V shape to a multiangular shape, such as for example a square, rectangular or trapezoidal shape.

Figure 2:
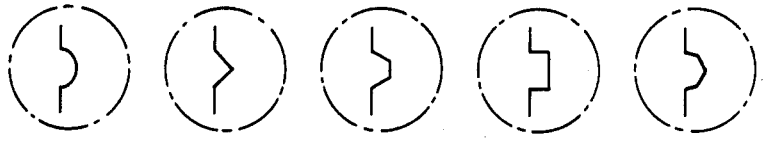

The invention will be more readily understood by reference to the accompanying drawing, in which FIG. 1 shows a non-limiting example of a capsule cap manufactured in accordance with the invention, while FIG. 2 shows in enlarged form representative configurations of the detail circled at A in FIG. 1.

FIG. 1 represents the cap portion of a size 1 capsule. The overall length of the size 1 capsule cap is 10 mm. A groove of depth 0.02 mm and width 0.50 mm is formed with its centre at a distance of 1.3 mm from the cut edge. The cap is formed on a pin having a corresponding profile.

The cross-sectional shape of the groove may have any convenient shape, and FIG. 2 indicates a non-exhaustive selection of suitable groove cross-sectional shapes which may be used.

The capsule shells of the invention may also incorporate other formations, such as, for example, locking formations as described in British Pat. Nos. 970761, 1040859 and 1442121.

In another aspect, the invention also comprises a pin having an annular groove suitable for making the capsule shell of the invention.

A series of trials were carried out to produce gelatin caps of different designs, containing either 2 "PRE-LOK" (registered Trade Mark) formations or 4 "PRE-LOK" formations (see GB No. 1442121). The caps were produced with a 0.02 mm groove as shown in FIG. 1.

TEST 1

Size 1 capsule caps were produced having 2 PRE-LOK formations and an annular groove as described above. Simultaneously were produced standard size 1 capsule caps having 4 PRE-LOK formations but with no annular groove. A sample of 50 caps of each sort was taken when the relative humidity was 15%. The ovality of each cap was determined by measuring its maximum and minimum diameters in mm and taking the difference. For the standard caps the average ovality was 0.127 mm, while for the capsules having the circular groove the average ovality was reduced to 0.089 mm.

TEST 2

The above test was repeated on a separate occasion and samples taken when the relative humidity was 14.5%. The standard capsules showed an average ovality of 0.132 mm while the capsules having the annular groove showed an average ovality of only 0.079 mm.

TEST 3

Size 1 capsule caps were produced having 2 PRE-LOK formations and an annular groove as in Test 1. Simultaneously were produced standard size 1 capsule caps having 2 PRE-LOK formations and also having the POSILOK (registered Trade Mark) formation described in GB No. 1442121, but with no annular groove. Fifty samples of each were taken at a relative humidity of 14.6%, and measured for ovality as in Test 1. The standard POSILOK caps had an average ovality of 0.102 mm, while the capsule caps of the invention had an average ovality of only 0.062 mm.

The decrease in ovality of the capsules of the invention leads to easier machine handling, such as sorting, filling and assembly, as well as improved printing. Because of the improvement in ease of assembly, the tolerance limits on manufacture can be decreased with the result that a better fit may be obtained between body and cap, with a reduction in accidental parting of the capsule halves subsequent to filling.

It is frequently desired to apply a sealing band to an assembled capsule, to prevent leakeage in the case of liquid fillings, or to render the capsule tamper-evident or tamper-resistant or for identification purposes. This can be achieved using known methods and equipment, such as the Quali-Seal machine (Manufacturing Chemist, Jan. 1987, p 27). In these circumstances the grooved capsule has been found to provide further surprising advantages when attaching the sealing strip and is particularly useful when the capsule contains a liquid filling. Firstly, the reduced ovality of the cap not only improves machine handling, i.e. produces smoother rotation and less wobble when rotated on the sealing machine for application of a sealing band, but more importantly, it has the effect that the circumferential gap between the cap and the body is more even than is found in capsules of conventional design. When a sealing band, such as a band of gelatin, is applied between the end of the cap and the body of the capsule, the gap which the sealing band has to span is more even and allows more regular sealing, while at the same time permitting a reduced thickness of gelatin banding material to be used. Secondly, the evenness of the circumferential gap referred to above, together with the closer dimensional tolerance and the additional retention barrier which can be achieved by the method of the invention provide additional advantages when the capsule is to contain a low viscosity liquid, such as evening primrose oil. In such liquid-containing capsules, it is necessary to prevent seepage of the thin oil or other liquid into the area to be sealed by banding or other techniques. Failure to prevent such seepage for the 5–10 minutes subsequent to filling, during which time the filled capsules may be sorted and orientated by machine into the correct position for sealing, results in failure of the sealing band to key onto the capsule over the whole contact area, with the risk of subsequent leakage of the contents from the capsule. It has been surprisingly found, on a test run of half a million capsules filled with primrose oil, that a marked decrease in leaking capsules resulted when the cap incorporating the annular groove of the invention was used.

We claim:

1. A capsule shell of the sort commonly employed to contain pharmaceutical preparations selected from a generally cylindrical capsule body portion, or a capsule cap portion which is adapted to fit telescopically onto the capsule body portion, wherein the said capsule body or cap portion contains an annular groove of from about 0.01 mm to about 0.05 mm deep in the region of the open end to reduce ovality in the open end of the capsule body or cap portion.

2. A capsule sheel of claim 1 which is a gelatin capsule shell.

3. The filled gelatin capsule comprising a capsule shell of claim 1.

4. The filled capsule of claim 3 having a sealing band applied between the end of the cap and the body of the capsule.

5. The filled capsule of claim 4, wherein the filling is a liquid filling.

6. A pin having an annular groove for making a capsule shell of claim 1.

7. The capsule shell of claim 1 wherein the annular groove is a continuous groove.

8. The capsule shell of claim 1 wherein the annular groove is at a distance of from about 0.5 mm to about 1.5 mm from the open end.

9. The capsule shell of claim 1 wherein the annular groove is from about 0.3 mm to about 1.5 mm in width.

10. The capsule shell of claim 1 wherein the depth of the annular groove is about 0.02 mm.

11. The capsule shell of claim 1 which is a capsule cap portion.

12. The capsule shell of claim 11 wherein the annular groove is a continuous groove.

13. The capsule shell of claim 11 wherein the annular groove is at a distance of from about 0.5 mm to about 1.5 mm from the open end.

14. The capsule shell of claim 11 wherein the annular groove is from about 0.3 mm to about 1.5 mm in width.

15. The capsule shell of claim 13 wherein the annular groove is from about 0.3 mm to about 1.5 mm in width.

16. The capsule shell of claim 11 wherein the depth of the annular groove is about 0.02 mm.

17. The capsule shell of claim 13 wherein the depth of the annular groove is about 0.02 mm.

18. The capsule shell of claim 14 wherein the depth of the annular groove is about 0.02 mm.

19. The capsule shell of claim 16 wherein the depth of the annular groove is about 0.02 mm.

20. The capsule shell of claim 19 wherein the annular groove is at a distance of about 1.3 mm from the open end, has a width of about 0.05 mm, and wherein the depth of the annular groove is about 0.02 mm.

* * * * *